US006767265B2

(12) United States Patent
Gamble et al.

(10) Patent No.: US 6,767,265 B2
(45) Date of Patent: Jul. 27, 2004

(54) GRIP PADS AND ARTICLE OF FOOTWEAR FOR USE THEREWITH

(76) Inventors: Craig Steven John Gamble, 8 Sorenson Circuit, Blackett (AU), NSW 2770; Andrew Glen Roche, 8 Dehavilland Avenue Benowa, Gold Coast (AU), QLD 4217

( * ) Notice: Subject to any disclaimer, the term of this patent is extended or adjusted under 35 U.S.C. 154(b) by 0 days.

(21) Appl. No.: 10/297,944

(22) PCT Filed: Jun. 28, 2001

(86) PCT No.: PCT/AU01/00785

§ 371 (c)(1),
(2), (4) Date: Mar. 26, 2003

(87) PCT Pub. No.: WO02/00497

PCT Pub. Date: Jan. 3, 2002

(65) Prior Publication Data

US 2003/0166364 A1 Sep. 4, 2003

(30) Foreign Application Priority Data

Jun. 28, 2000 (AU) ..... PQ8388
Mar. 5, 2001 (AU) ..... PR3484
Mar. 13, 2001 (AU) ..... PR3651

(51) Int. Cl.[7] ..... B63B 35/79
(52) U.S. Cl. ..... 441/74; 428/100
(58) Field of Search ..... 441/74, 68, 65; 428/99, 100; 36/131, 132, 136, 15; 280/11.3

(56) References Cited

U.S. PATENT DOCUMENTS 4,041,562 A 8/1977 Nealy
4,108,452 A * 8/1978 Baron ..... 280/11.3
4,285,082 A 8/1981 Cox
4,457,510 A 7/1984 Pertshuk
4,645,466 A * 2/1987 Ellis ..... 441/74
4,729,370 A * 3/1988 Kallassy ..... 602/65
4,775,345 A 10/1988 Gifford
4,820,220 A * 4/1989 Fruzzetti et al. ..... 441/74
4,938,725 A * 7/1990 Beck ..... 441/75
5,050,620 A * 9/1991 Cooper ..... 602/27
5,129,101 A 7/1992 Douglas
5,170,574 A * 12/1992 Weisbrich ..... 36/131
5,308,271 A * 5/1994 Foulke ..... 441/74
5,435,765 A * 7/1995 Fletcher ..... 441/74
5,454,743 A * 10/1995 Simonson ..... 441/74
5,766,051 A * 6/1998 Messer ..... 441/65
6,440,526 B1 8/2002 Gamble

FOREIGN PATENT DOCUMENTS

AU 67354/94 8/1981

* cited by examiner

*Primary Examiner*—S. Joseph Morano
*Assistant Examiner*—Lars Olson
(74) *Attorney, Agent, or Firm*—Shoemaker and Mattare

(57) ABSTRACT

A grip pad assembly (10) including an outer pad member (12) having an upper surface defining a non-slip surface and an insert (18) within the pad member (12) having on its upper surface, a hook and loop material (20) and a central ridge (22). The pad assembly (10) may be used on a surfboard, or other watercraft, or in any other application where enhanced grip is required, in combination with an article of footwear (40). The article of footwear (40) comprises a first retaining portion (45, 46) adapted to extend over and be secured to the foot of a user, a second retaining portion (43, 44) adapted to extend over and be secured to the ankle of the user and a complementary hook and loop fastener (47) on its undersurface. The footwear may have a means (51) for securing a leg rope for connection to the surfboard.

20 Claims, 8 Drawing Sheets

GRIP PADS AND ARTICLE OF FOOTWEAR FOR USE THEREWITH

TECHNICAL FIELD

This invention relates to grip pads which in particular are suited for use in wet or slippery areas and most particularly for use on watercraft such as surfboards. This invention also relates to an article of footwear for use with such pads.

BACKGROUND ART

Watercraft such as surfboards generally have a smooth fiberglass surface. To improve grip a wax coating may be applied however this is a tedious process and needs to be repeated at regular intervals. Additional forms of grip enhancing means comprise pads of a suitable plastics material however pads of this form whilst assisting in preventing slip, do not provided a positive grip between a surfboard rider and the surfboard.

In our Australian Patent No 713636, we disclose a deck pad for use in combination with a garment worn by a person, the pad having a zone or zones of a hook and loop type fastener and the garment having one or more zones of a complementary hook and loop type fastener. By varying the position of placement of the garment on the pad, the contact between the zones can be varied to control the extent of engagement between the garment and pad. The pad can be used in a number of different applications such as a deck pad on a watercraft such as a surfboard in which case the garment is in the form of an article of footwear having on its underside the zone or zones of hook and loop type fastener. Whilst this pad functions efficiently, wear on the hook and loop fastener can necessitate replacement of the whole pad and similarly if different grip properties are required.

The article of footwear however is usually in the form of a bootie in which case left and right boots are required to be worn by the user. Further as the footwear is in the form of a bootie, the whole of the foot is covered so that a user, say of a surfboard, lacks "feel".

SUMMARY OF THE INVENTION

The present invention aims to provide in one aspect an improved deck or grip pad for use on watercraft such as surfboards or other watercraft, skateboards or any other article, or in any other area where enhanced grip is required. The present invention further aims to provide an article of footwear designed particularly to be used with a pad of the type described above but which may be used with any other complementary pad. The present invention furether aims to provide an article of footwear which may be used both on the left and right foot and which will be effective and efficient in use. Other objects and advantages of the invention will become apparent from the following description.

The present invention thus provides in a first aspect a deck pad assembly, said pad assembly comprising a pad member and at least one insert within said pad member, said pad assembly being adapted to be attached to the deck of a watercraft, skateboard or other article to which enhanced grip is required, said insert or inserts having on its or their upper surface, a hook and loop fastener adapted for cooperation with a garment having one or more zones of a complementary hoop and loop fastener.

In use, by varying the position of placement of the garment on the pad or pad assembly and thus varying the contact between the hook and loop fastener of the garment and the pad assembly, the person wearing the garment can selectively control the extent of engagement and thus grip between the garment and pad assembly.

The term "hook and loop fastener" as used in the present specification refers to either portion of a fastener comprising two portions, namely a hook portion and a portion complementary to the hook portion for example a loop portion such that the two portions are releasable interconnected when brought into contact with each other. Such fasteners are known under the trade mark VELCRO. The use of the term also includes those types of fasteners known as hook and hook fasteners in which there are opposing portions of interlockable hooks. The term also includes any other touch and grip type fastener of the type in which temporary interconnection is achieved when the two components thereof are brought into contact with each other.

The pad assembly of the present invention may be used for any application where it is desirable for a person's grip on a surface to be enhanced. For example, the pad assembly may be attached to the deck of articles such as surfboards, body boards, skateboards, jet skis, sailboards and yachts.

Thus in a further particular aspect the present invention provides a surfboard deck pad assembly for attachment to the deck of a surfboard, said pad assembly including a pad member and at least one insert within said pad member, said at least one insert having on its upper surface, a hook and loop fastener and said pad member having a zone or zones comprising a non-slip surface. The zone or zones of hook and loop fastener may substantially cover the insert.

Alternatively, the pad assembly can be in the form of a mat for placement on slippery or other wet surfaces such as wet floors and also in snow and ice. Thus in a further aspect, the present invention provides a ground or floor pad assembly for use on slippery surfaces such as wet areas or in snow or on ice in combination with a garment worn by a person, said pad assembly comprising a pad member and at least one insert within said pad member, said pad assembly having a plurality of grip enhancing zones having different grip properties, at least one of said zones comprising a hook and loop fastener on said at least one insert and said garment having one or more zones of a complementary hoop and loop fastener such that in use, by varying the position of placement of said garment on said pad assembly and thus varying the contact between said zones of said garment and said pad assembly, said person wearing the garment can selectively control the extent of engagement between said garment and said pad assembly to vary the grip between said garment and said pad assembly.

The pad assembly may have more than one insert, each carrying the hook and loop fastener such that in use a person can control the extent of engagement between the garment and the pad assembly by selectively engaging different proportions of the hook and loop fastener on the inserts or different inserts. The hook and loop type fastener may be of any size, location or density depending upon the desired use of the pad assembly. Most preferably however the hook and loop fastener covers substantially all of the upper exposed surface of the insert or inserts.

The pad member of the pad assembly is suitably apertured to receive the insert or inserts, the insert or inserts for this purpose having an external configuration complementary to the shape of the aperture. The pad member may have a single central aperture to receive an insert such that the pad member peripherally surrounds the insert carrying the hook and loop fastener. The pad member may have more than one aperture to receive respective inserts.

The insert may have one or more raised ribs or ridges on its upper side to enhance grip. The nbs or ridges suitably extend longitudinally relative to the pad assembly.

The insert or insert may have zones of hook and loop fastener having different densities of either hooks or loops. A zone of hook and loop fastener with a low density of hooks or loops will normally engage a garment having a complementary fastener to a lesser extent than a zone having a high density of hooks or loops. The extent of engagement can be controlled by selectively engaging zones having different densities.

Most preferably the pad member includes at least one zone of a non-slip material defining a non-slip surface. The zone of the non-slip material suitably covers substantially all of the upper surface of the pad member. Such a pad member is especially suitable for use on watercraft such as surfboards. A rider is able to disengage part of the garment whilst remaining in contact with the non-slip surface. This is desirable in applications such as surfboards as it allows a rider to optimize control and/or grip of the surfboard as desired.

Non-slip materials which may be used in the preferred pad member are known and typically include flexible foam materials. Suitable foam materials include urethanes, vinylchloride foam material or olefinic materials such as polyethylene and copolymers of ethylene with vinyl acetate. An especially preferred material is ethylene vinyl acetate foam (EVA). The physical properties of the foam may vary and may be selected according to the desired substrate to which the pad assembly is to be attached. For example, if the pad assembly is to be used on areas where shock absorption is required, the density and thickness of the foam may be varied accordingly. Preferably the foam has a thickness of 6 to 12 mm and most preferably about 10 mm. The surface of the material may also be modified as desired and may be embossed or moulded in an anti-slip friction increasing pattern. Preferably when the pad is to be used on watercraft the foam is provided with water shedding channels or the like.

The pad assembly is suitably attachable to the deck or other substrate typically by an adhesive. Preferably, the lower surfaces of both the pad member and insert are provided with a layer of a pressure sensitive or contact adhesive. The adhesive is typically strong enough to allow the components of the pad assembly to remain on the substrate during use, but to allow the pad member and/or insert to be removed and replaced as desired. It will be appreciated that in some applications the pad assembly may simply be placed on a surface without an adhesive and may be held in place by frictional engagement between the lower surface of the pad assembly and the substrate. Pad assemblies of this type may be in the form of mats for placement on wet or other slippery areas when and where desired. Preferably, both the pad member and insert are provided with a self adhesive backing to enable the pad member and insert to be secured separately to the surface to which the pad assembly is to be attached. This enables either the insert or the pad member to be replaced in the event of wear or substitution or replacement if an insert or pad member having different properties is required. For example, the insert may be provided with a hook and loop material of different density or with sections of different densities.

Preferably, the hook and loop fastener on the insert is disposed, at least around the outer periphery of the insert, below the surface of the adjacent portions of the pad member to reduce the possibility of detachment of the hook and loop fastener from the insert or detachment of the insert itself. Most preferably, the outer edges of the hook and loop fastener are folded downwardly around the periphery of the insert.

Whilst the insert in the above configuration is used in combination with a surrounding pad member, it may also be used itself as a separate grip pad. Thus, the present invention in a further aspect provides a grip pad, said pad having an upper side, a hook and loop fastener substantially covering said upper side and adapted for cooperation with a garment having one or more zones of a complementary hoop and loop fastener, said pad further having on is upper side at least one raised grip enhancing ridge.

In yet a further aspect, the present invention provides a surfboard deck pad for attachment to the deck of a surfboard, said pad having an upper side, at least one raised ridge on said upper side, and a hook and loop fastener substantially covering said upper side. The pad when applied to use on a surfboard suitably is of elongated form and the ridge or ridges suitably extend longitudinally relative to the pad.

In yet a further aspect, the present invention provides a ground or floor pad for use in combination with a garment worn by a person, said pad having an upper side, a grip enhancing zone comprising a hook and loop fastener substantially covering said upper side, and at least one raised ridge on said upper side and said garment having a zone or zones of a complementary hook and loop fastener such that in use, by varying the position of placement of said garment on said pad and thus varying the contact between said hook and loop fasteners of said garment and said pad, said person wearing the garment can selectively control the extent of engagement between said garment and said pad to vary the grip between said garment and said pad. The hook and loop type fastener may be of any size or density depending upon the desired use of the pad.

The pad suitably includes a body having an upper surface which is covered in the hook and loop fastener. The material of the body may comprise a foam material. Suitable foam materials include urethanes, vinylchloride foam material or olefinic materials such as polyethylene and copolymers of ethylene with vinyl acetate. An especially preferred material is ethylene vinyl acetate foam (EVA). The physical properties of the foam may vary and may be selected according to the desired substrate to which the pad is to be attached. For example, if the pad is to be used on areas where shock absorption is required, the density and thickness of the foam may be varied accordingly.

The pad suitable is formed by having the body moulded with the ridge or ridges integral. The ridge or ridges may extend only part way along the pad or fully along the pad. Where one ridge is provided, it preferably is located centrally of the pad which is preferably of elongated form. Where more than one ridge is provided, they are suitably arranged symmetrically relative to the longitudinal centerline of the body. The hook and loop fastener may be affixed to the upper surface of the body by adhesives or alternatively may be moulded with the base.

The pad typically is used in combination with a garment worn by a person to enable the person to grip or engage the pad. Typically the garment's outer surface has at least one complementary portion of the hook and loop fastener affixed thereto. The outer surface of the garment may be completely covered with the hook and loop fastener or may have one or more sections of the hook and loop type fastener attached thereto. Alternatively the garment itself may be made from a looped portion which can engage a corresponding hooked portion on the pad. Preferably however the looped portion of the hook and loop fastener is on the pad and the hooked portion is attached to the garment.

Any type of garment may be used in combination with the pad assembly or grip pad and any part of a garment can be adapted for engagement with the pad or pad assembly. For example, the garment may comprise a wetsuit or the like in which the hook and loop fastener is affixed to the chest portion. Such a garment would be suitable for use with a surfboard or body board to facilitate grip when paddling or riding. In applications where it is desirable that there is a large amount of grip between the garment and grip pad or pad assembly such as on a surfboard for aerial maneuvers, the surface area of hook and loop fastener on garment is at least the size surface area of the hook and loop type fastener the grip pad or insert of the pad assembly so as to provide the maximum engageable surface. Alternatively in applications where such a degree of engagement is not required, such on the deck of a boat, the zones of hook and loop fastener may be substantially smaller. The surface or surfaces of the grip pad or insert may also have areas in which the distribution of the hook and loop fastener varies. The grip pad and insert may have zones of hook and loop fastener having different densities of either hooks or loops. A zone of hook and loop with a low density of loops will normally engage a garment having a complementary surface to a lesser extent than a zone having a high density of hooks or loops. The extent of engagement can be controlled by selectively engaging zones having different densities.

Most preferably, the garment for use with the pad assembly or grip pad is a boot, sandal or other article of footwear or may be adapted to be fitted over existing footwear such as a boot.

Thus in a further aspect, the present invention provides article of footwear having a first retaining portion adapted to extend over and be secured about the foot of a user and a second retaining portion adapted to extend around and be secured to the ankle of a user, and a grip zone comprising a hook and loop fastener adapted to be located in use under the foot of the wearer so as to leave the toes and the heel free, said hook and loop fastener being adapted to be releasably connected to a grip pad or article having a complementary hook and loop fastener.

The present invention in further aspect provides article of footwear for use with a surfboard or other water-craft, said article of footwear including a first retaining portion adapted to extend over and be secured to the foot of the user and a second retaining portion adapted to extend around and be secured to the ankle of a user, and means for attaching a leg rope for connection to said surfboard or other water-craft.

The article of footwear suitably comprises a main body formed of a wetsuit material such as neoprene or any other material which is flat or planar prior to attachment to the foot of the user.

The first retaining portion suitably includes opposite straps which may be formed integrally with the main body and which may be looped about the foot of the user and interconnected. Suitably, the straps carry complementary hook and loop fasteners which permit the straps to be interconnected. One of the portions of hook and loop fastener on one strap may be extended to form a tongue which may be passed back over the hook and loop fastener of the other strap to ensure secure interconnection between the straps.

Preferably, the second retaining portion also includes opposite straps suitably formed integrally with the main body which may be interconnected about the ankle of the user. The straps suitably carry zones of complementary hook and loop fastener which cooperate to secure the strap around the ankle. The strap may include a plurality of zones of hook and loop fastener which may be sandwiched between each other to enhance interconnection of the straps.

Where a leg rope is used it may be connected to the second retaining portion of the footwear by any suitable connection arrangement known in the art or alternatively, a leg rope may be releasably connected to the second retaining portion by a looped fastening arrangement. Webbing may be incorporated into the second retaining portion to strengthen the ankle straps and the leg rope may be connected to the webbing such that the footwear article may be used in place of the conventional surfboard leg rope assembly.

Thus in a further aspect, the present invention provides leg rope assembly for attachment to a surfboard or other water-craft, said leg rope assembly comprising a foot engaging portion, said foot engaging portion including a first retaining portion adapted to extend over and be secured to the foot of the user and a second retaining portion adapted to extend around and be secured to the ankle of a user, and a leg rope fixed at one end to or adjacent said second retaining portion.

As an alternative, the footwear article may be used in combination with a conventional strap of a leg rope which is attached to the surfboard. For this purpose, loops may be provided on the inside of the second retaining portion to receive a conventional leg rope strap. In a further arrangement, the strap of the leg rope may be secured around the second retaining portion of the footwear article.

The main body of the footwear article also suitably includes a central opening for receipt of the heel of the user, the opening being shaped so as to in effect expand to accommodate the heel.

Where used with a pad assembly of the above described type, a person can locate the foot on the pad assembly so as to engage the hook and loop fastener on the footwear article with the rib or ribs on the insert carrying the complementary hook and loop fastener, and leaving the toe and heel of the foot on the pad member.

Where used with a grip pad of the above described type, the grip pad is preferably of a width less than the distance between the toes and heel of a person wearing the footwear article. Thus in use, a person can locate the foot on the pad so as to engage the hook and loop fastener with the rib or ribs on the insert carrying the hook and loop fastener leaving the toe and heel of the foot of the user free for contact with the surfboard such as to give the user "feel" to facilitate maneuvers.

The part of the lower surface of the article of footwear which corresponds to the arch of the foot is typically covered by the hook and loop fastener however that part may be provided with different zones of hook and loop fastener provided for example in strips extending transversely of the foot in use. The zones of hook and loop fastener may have different grip properties to vary in use the extent or nature of engagement between the footwear article and pad assembly or grip pad.

BRIEF DESCRIPTION OF THE DRAWINGS

In order that the invention may be more readily understood and put into practical effect, reference will now be made to the accompanying drawings which illustrate preferred embodiments of the invention and wherein.

Figure 1:
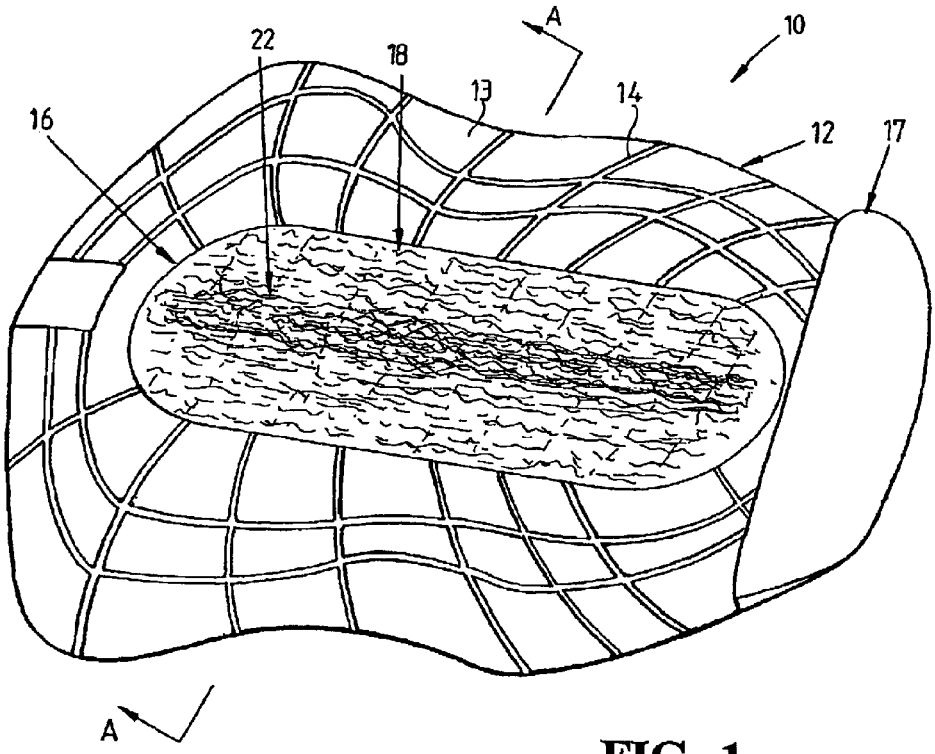
FIG. 1 illustrates a preferred pad assembly of the present invention for use with a surfboard according to a first embodiment of the invention.

The embodiments shown in the drawings and referred to below describe the application of the pad assembly and grip pads of the invention and associated footwear to a surfboard however it will be appreciated that the pad assembly, pad and footwear article may be applied to any other article or in any other area where an enhanced grip is required.

DETAILED DESCRIPTION OF THE PREFERRED EMBODIMENT

Figure 3:
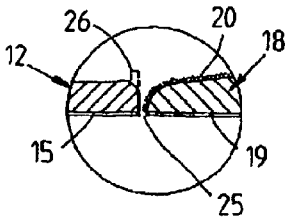
FIG. 3 is an enlarged view of the region B of FIG. 2.
Figure 4:
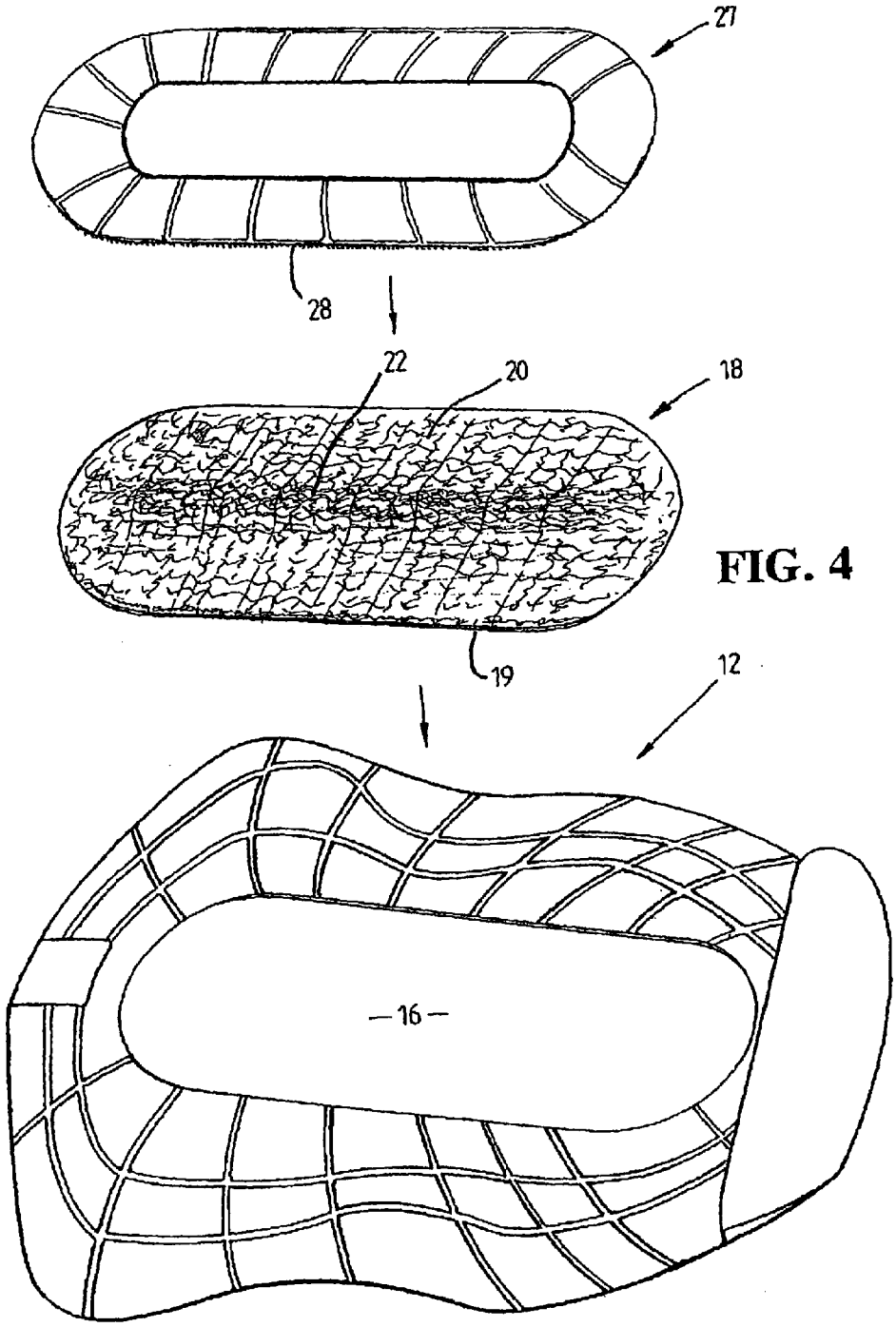
FIG. 4 illustrates in exploded view components of the pad assembly.
Figure 5:
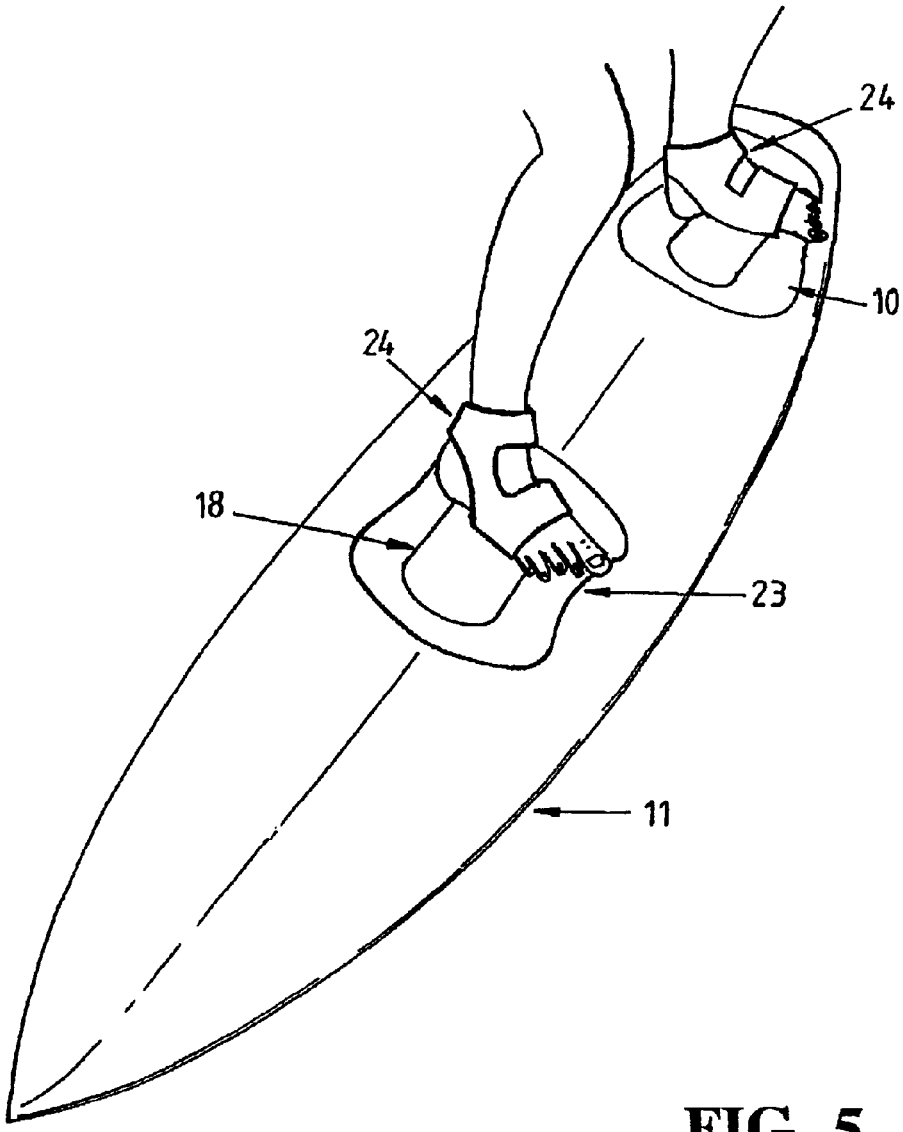
FIG. 5 illustrates a surfboard having the pad assemblies of the invention affixed thereto engaged by the rider of a surfboard.

Referring firstly to FIGS. 1 to 4, there is illustrates a grip pad assembly 10 according to a first embodiment of the invention for use typically on a surfboard 11 (see FIG. 5). The pad assembly 10 includes an outer pad member 12 made from EVA or any other suitable plastics cushioning material which is moulded on its upper surface with a plurality of grip enhancing raised lands 13 separated by water shedding channels 14. The pad member 12 is provided on its underside with a self adhesive layer 15 which may be covered by a backing strip which may be removed to allow the pad member 12 to be secured to the surface of the surfboard 11 and further includes a raised step 17 along its rear edge or heel portion.

The pad member 12 in this embodiment has a central opening or cut-out portion 16. An insert 18 of complementary shape to the central opening 16 is adapted to be located within the opening 16 and also adhered to the surface of the surfboard 11. The insert 18 for this purpose also has a self adhesive layer 19 covered by a backing which may be removed to enable adherence as above. The insert 18 is provided on its upper surface with one part such as the loop portion of a hook and loop fastener 20. Preferably the insert 18 is constructed of a base 21 of an EVA or other plastics material to which the hook and loop fastener 20 is affixed or adhered. Alternatively the base 21 may be moulded to the underside the hook and loop fastener 20. The base 21 is formed with an integral central raised nib or arch bar 22 which extends longitudinally of the insert 18.

The pad assembly 10 is designed to be affixed to a rear section of a surfboard 11 as shown in FIG. 5 on the longitudinal axis of the surfboard 11 and with the insert 18 and rib 22 of the insert, 18 extending longitudinally. Where required for use on the front of the surfboard 11 or in a mid-section thereof, a pad assembly 23 similar to the pad assembly 10 is used however in this case the raised step 17 is omitted.

The pad assemblies 10 and 23 are arranged to be used with an article of footwear 24 (an example of which is described further below) which may be secured to the foot of a user and which has a lower surface beneath the arch of the foot to which is attached the hook portion of a hook and loop fastener for cooperation with the loop portion of the hook and loop fastener 20 on the pad insert 18 of respective pad assemblies 10 and 23.

In use, the rider can place his feet on the pad assemblies 10 and 23 by locating the arch of the foot on ribs 22 on the inserts 18 and over the ribs 22 as shown in FIG. 5. This "locks" the rider onto the surfboard 11 through the engagement between the complementary hook and loop fasteners on the article of footwear 24 and inserts 18. This allows the rider to undertake aerial maneuvers which are enhanced through the attachment between the rider and the surfboard 11. Variation of the engagement between the rider and the surfboard 11 can be achieved by repositioning the feet on the pad assemblies 10 and 23 so that there is more or less engagement with the hook and loop fastener 20 on the inserts 18 and the non-slip material is of the outer pad members 12.

Figure 2:
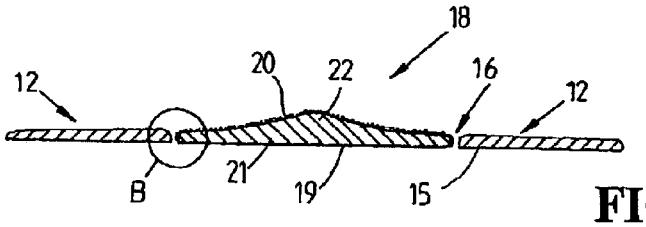
FIG. 2 is a sectional view along line A—A of FIG. 1.

As shown in FIGS. 2 and 3, the hook and loop fastener 20 on the insert 18 which is in the form of a planar fabric-like material is folded or rolled down over and around the outer periphery of the insert base 21 so as to commence at 25 from the lower surface of the insert base 21. This will reduce the risk of the hook and loop fastener 20 becoming detached when sliding the foot over the pad assembly 10 (or 23). In a particularly preferred form, the inner edge of the outer pad member 12 may be provided with a raised rib 26 (shown in dotted outline in FIG. 2) to further protect the hook and loop fastener 20 on the insert 18 to prevent its detachment 17.

Where it is desired that the pad assembly 10 be used for conventional surfing, the hook and loop fastener 20 of the insert 18 may be covered with an overtread 27 (see FIG. 4) provided on its underside with a hook and loop fastener 28 complementary to the fastener 20 on the insert 18. The overtread 27 which suitably is formed of the same material as the outer pad member 12 may be provided on its upper surface with a grip enhancing pattern which is the same as on the pad member 12 or an alternative grip enhancing pattern. Advantageously the overtread 27 may be the portion of the pad member 12 formed by cutting out of the opening 16. The pad assembly 10 (or 23) when the insert 18 is covered with the overtread 27 which engages therewith through the cooperative hook and loop fasteners 28 and 20 will be converted simply to a grip enhancing pad.

It will be appreciated that the insert 18 may be removed and replaced by an insert with an alternative rib configuration, with alternative grades of hook and loop fastener or simply with a self adhesive pad similar to the overtread 27 to again convert the pad assembly 10 to a grip enhancing pad similar to a pad of conventional form. It will be further appreciated that the pad assemblies 10 and 23 may be in many different shapes and configurations and may include a number of inserts 18 carrying hook and loop fastener 20 if desired. A surfboard 11 may carry only one pad assembly or spaced pad assemblies as illustrated.

In an alternative configuration, the insert 18 may be adhered or attached to the pad member 12. The pad member 12 for this purpose may include a base layer or layers which is adhered to the substrate such as a surfboard deck and the opening 16 is in this case formed as a recess in the pad 12. The insert 18 may then be secured to the base layer or layers within the recess by self adhesive means or other attachment means.

Whilst the insert 18 described above is used in combination with an outer pad member 12 having a grip enhancing surface pattern, it may itself be used separately as a grip enhancing pad as shown and described with reference to FIGS. 6 and 8. As illustrated, a pad 30 according to this embodiment of the invention again is for use typically on a surfboard 31 (see FIG. 8), the pad 30 including a base 32 made from EVA or any other suitable plastics cushioning material. The base 32 is provided on its underside with a self adhesive layer 33 which may be covered by a backing strip which may be removed to allow the pad 30 to be secured to the surface of the surfboard 31.

The pad 30 in this embodiment is of elongated form and rounded at opposite ends and is provided on its upper surface with the loop portion of a hook and loop fastener 34. Preferably the base 32 is adhered to the hook and loop fastener 34, which is in the form of a planar fabric-like material, by a suitable adhesive. Alternatively the base 32 may be moulded to the underside the hook and loop fastener 34. For enhancing grip, the base portion 32 is formed with an integral central raised ridge or arch bar 35 which extends longitudinally of the pad 30. The pad 30 preferably has a maximum transverse width "W" less than the distance between the toes and heel of a user for a purpose which will hereinafter become apparent.

Figure 8:
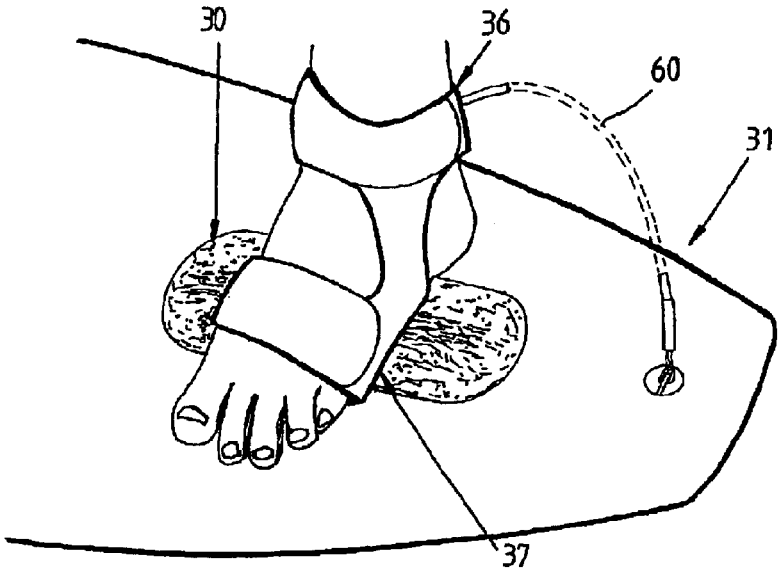
FIG. 8 illustrates a surfboard having a pad of the invention affixed thereto and the manner of engagement by footwear worn by a surfboard rider.

The pad 30 may be adhered to a rear section of a surfboard 31 on the longitudinal axis of the surfboard 31 and with the ridge 35 extending longitudinally as shown in FIG. 8. Where required for use on the front or mid-section of the surfboard 31, a further similar pad 30 may be adhered in a similar manner.

The pads 30 are arranged to be used with an article of footwear 36 which may be attached to the ankles of a user and which has a lower surface beneath the arch of the foot to which is attached or which carries a hook portion of a hook and loop type fastener 37.

In use, the rider can place his feet on a pad 30 by locating the arch of the foot on ridge 35 of the pad 30. This "locks" the rider onto the surfboard 31 through the engagement between the complementary hook and loop fastener 34 and 37 and allows the rider to undertake aerial maneuvers which are enhanced through the attachment between the rider and the surfboard 31. Variation of the engagement between the rider and the surfboard 31 can be achieved by repositioning the feet on the pad 30 so that there is more or less engagement with the hook and loop material 34 on the pad 30. The toes and heel of the user however extend over the opposite sides of the pad 30 to enable engagement with the surface of the surfboard 31 adjacent the pad 30 to improve "feel" and provide a secondary grip.

Figure 7:
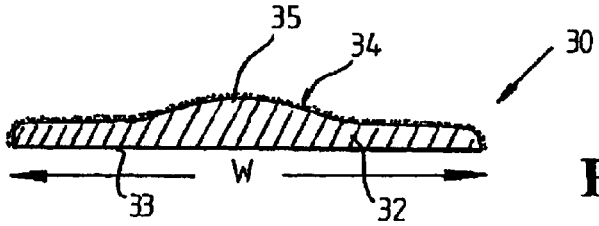
FIG. 7 is a sectional view along line C—C of FIG. 6.

As shown in FIG. 7, the hook and loop material 34 is folded or rolled down over around the edges of the base 32 so as to commence from the lower surface of the pad 30. This will reduce the risk of the hook and loop material 34 becoming detached when sliding the foot over the pad 30.

Where it is desired that the pad 30 be used for conventional surfing, the hook and loop fastener 34 of the pad 30 may be covered with an overtread provided on its underside with a complementary hook and loop fastener (and which for example may be in the form of the overtread 27 of FIG. 4). The overtread which suitably is formed of EVA or other plastics material may be provided on its upper surface with a grip enhancing pattern. The pad 30 when covered with the overtread which engages therewith through the cooperative hook and loop fastener will be converted simply to grip enhancing pads.

It will be appreciated that the pads 30 may be removed and replaced by pads 30 with an alternative ridge configurations, or with alternative grades of hook and loop fastener 34. It will be further appreciated that the pads 30 may be in many different shapes and configurations. The pads 30 may be used in any orientation on a surfboard and may be used in combination with conventional deck grip pads if desired.

A typical article of footwear 40 for use with the pad assembly 10 or pad 30 as described above is shown in FIGS. 9 to 14. The article of footwear 40 according to the present invention includes a main body 41 formed of a wetsuit type material such as neoprene and which normally is planar. The main body 41 for example may be simply cut using a cutting knives or other severing means from a planar sheet of neoprene. The main body 41 includes a central portion 42 and first pair of opposite straps 43 and 44 extending to opposite sides of the portion 42 and a second pair of opposite straps 45 and 46 extending to opposite sides of the portion 42, the straps 43 and 44 being adapted to be passed around the ankle of the user and the straps 45 and 46 being adapted to be passed about the foot of the user. The central portion 42 includes on its normal outer side a zone 47 of hook and loop fastener defined by a pad secured such as by gluing or sewing to the central portion 42. The zone 47 in this embodiment preferably comprises the hook portion of a hook and loop fastener. The central portion 42 also includes a somewhat heart shaped aperture 48 which in use receives the heel of the user.

The strap 43 includes on one side, the normally inner side, a pad 49 of hook and loop fastener suitably hook fastener secured by gluing or sewing to the strap 43 whilst the strap 44 on the opposite or outer side includes a pad 50 of complementary hook and loop fastener suitably loop fastener. The central portion 42 may also include on its outer side a strap 51 of webbing aligned with the straps 43 and 44 for strengthening the ankle strap region and for incorporating if desired a surfboard leg rope (as described further below). The hook and loop fastener pads 49 and 50 do not extend to the end of the respective straps 43 and 44 so that a portion for gripping by the hand of a user is left free.

The strap 45 also includes a pad 52 of hook and loop fastener on one (the outer) side, and the strap 46 includes a pad 53 of complementary hook and loop fastener on the opposite (the inner) side. Suitably the pad 52 comprises hook material and the pad 53 comprises a complementary loop material. The pad 52 suitably extends around the end of the strap 45 as at 52' whilst the pad 53 includes a free tongue 53' on it inner end for enhancing attachment as described further below.

The central body portion 42 also includes loops 54 adjacent the junction of the straps 43 and 44 with the portion 42 on the inner side of the footwear article 40 for receipt of the ankle strap of a conventional leg rope if desired.

Figure 14:
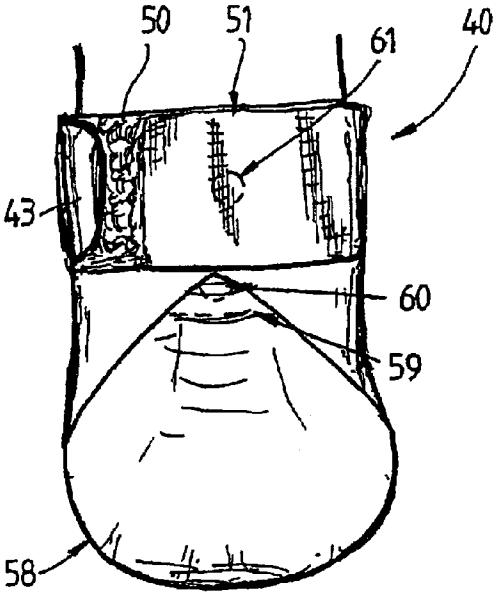
FIG. 14 is a rear view showing the article of footwear applied to the foot of a user.
Figure 13:
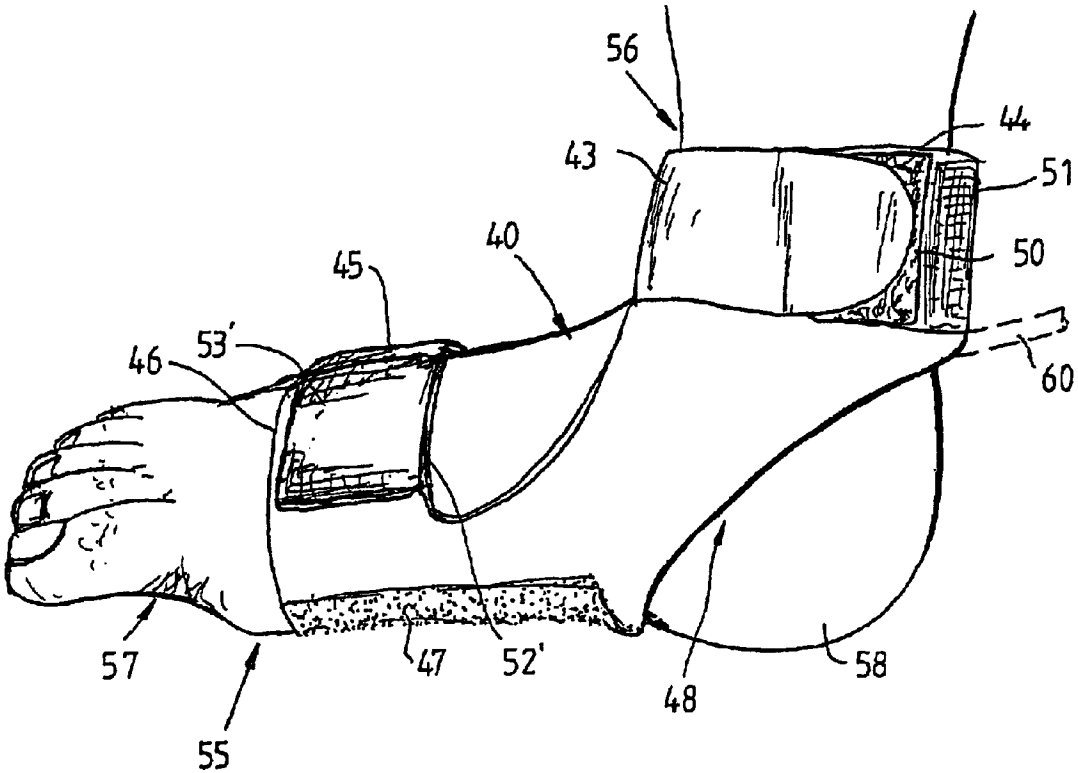
FIG. 13 illustrates in side view the article of footwear applied to the foot of a user.

In use and as shown in FIGS. 13 and 14, the footwear article 40 is applied to the foot 55 of a user by pushing the heel into the opening 48, and passing the straps 43 and 44 around the ankle 56 and the straps 45 and 46 around the fore part 57 of the foot 55. As is apparent, the strap 44 is located against the ankle 56 whilst the strap 43 overlaps the strap 44 with the straps being interconnected through the cooperating pads 49 and 50 of complementary hook and loop fastener. Similarly, the strap 46 is located against the fore part 57 of the foot 55 whilst the strap 45 overlaps the strap 46 and is connected thereto by the complementary pads 52 and 53. For additional security, the tongue 53' is looped back to engage with the pad portion 52' on the upper side of the strap 45. The connection between the straps 43 and 44 and 45 and 46 are suitably achieved by pulling the straps tightly about the foot and then engaging the complementary pads as described above so that the footwear article 40 is firmly held to the foot 55. The article of footwear 40 when applied to the foot 55 leaves the toes and forward part 57 of the foot free as well as the heel 58 so that the user is able to "feel" the underneath surface.

Where the footwear article 40 is to be used in combination with a conventional leg rope for attachment to a surfboard, the leg rope normally includes an ankle strap which includes portions of complementary hook and loop fastener for attachment about the ankle. The conventional ankle strap 59 shown in dotted outline in FIG. 9 may be passed through the loops 54 and attached firstly around the ankle 56 prior to attachment of the footwear article 40. The leg rope 60 may be passed out through the opening 48 for connection to a surfboard. Alternatively, the strap 59 of the leg rope may be secured around the ankle 56 over the straps 43 and 44 after the latter have been secured together, or secured around the ankle 56 above the straps 43 and 44.

In an alternative arrangement, a leg rope 60 may be attached to the webbing 51 at the position 61 (see FIGS. 8, 13 and 14) using a conventional anchoring arrangement such that the footwear article 40 can take the place of a conventional foot strap. Of course in this embodiment, the grip pad 47 may be eliminated so that the footwear article 40 can be used in all applications where conventional leg ropes are used.

Figure 6:
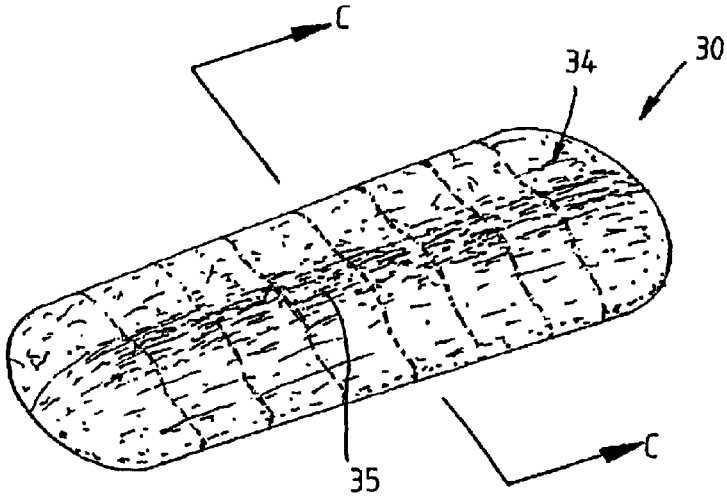
FIG. 6 illustrates a preferred pad of the present invention for use with a surfboard according to a second embodiment of the invention.
Figure 15:
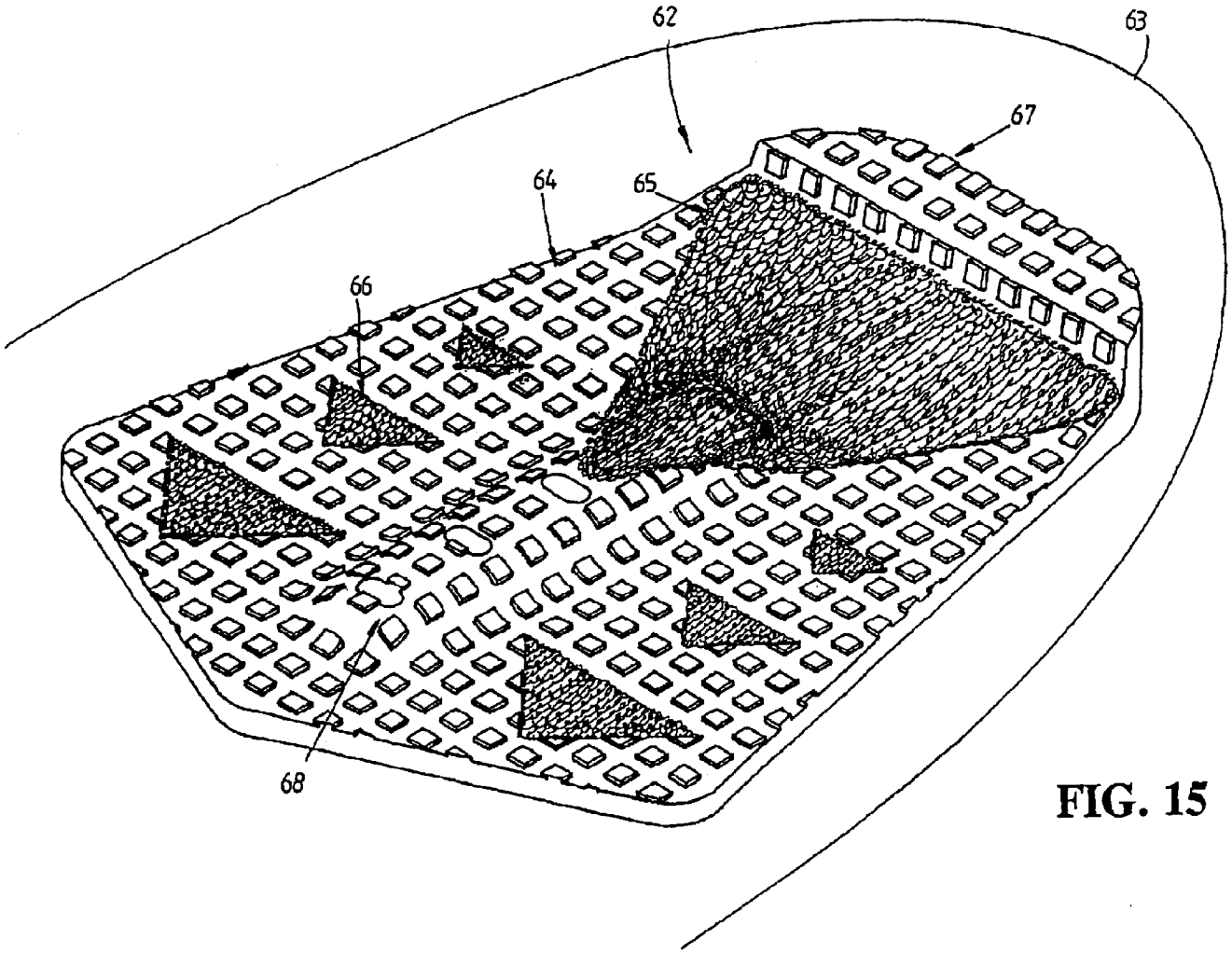
FIG. 15 illustrates a further form of surfboard grip pad with which the article of footwear may be used.

The footwear article 40 may be used with pad assemblies of the type shown in FIGS. 1 to 4 or grip pads of the type shown in FIGS. 6 to 8. Alternatively, the footwear article 40 may be used with a pad 62 of the type shown in FIG. 15 which may be located at the rear of a surfboard 63. The pad 62 includes a grip surface 64 and zones 65 and 66 of hook and loop fastener which are complementary to the fastener zone or pad 57 on the footwear article 40. The pad 62 in this embodiment also includes a raised step 67 which provides a secondary grip. The wearer of the footwear article 40 may simply control the extent of engagement of the foot with the pad 62 by positioning the fastener zone or pad 57 as desired on the zones 65 or 66. This can be done with both feet where pads are provided at the rear of the board and towards the nose respectively or only one foot where only one pad 62 is provided on the surfboard 63. For detachment of the footwear article 40 from one of the zones 65 or 66, the user may pivot his foot upwardly about the ankle or toes to release the complementary gripping hook and loop fasteners.

Figure 9:
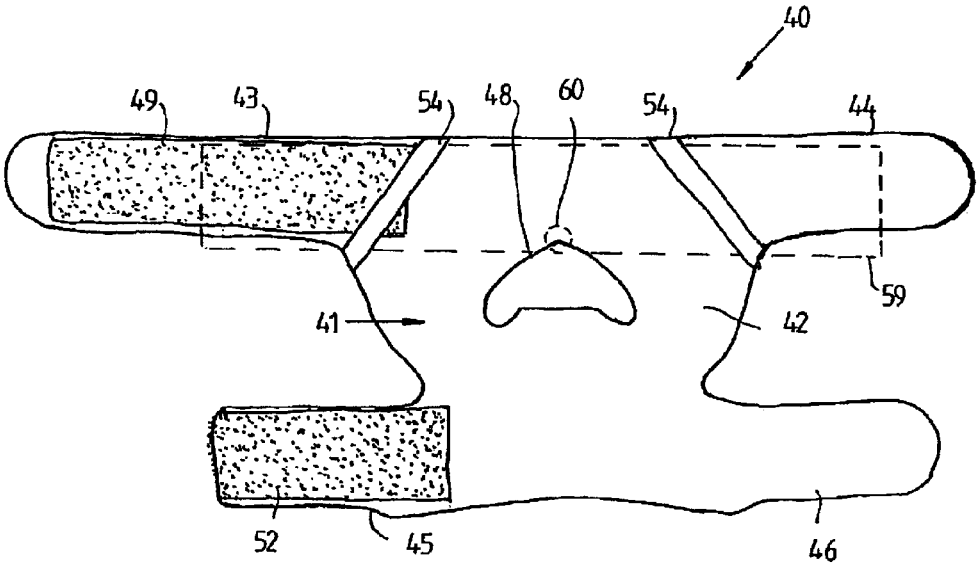
FIGS. 9 and 10 are opposite side views of the article of footwear for use with the above pads according to an embodiment of the invention in a substantially planar attitude.
Figure 10:
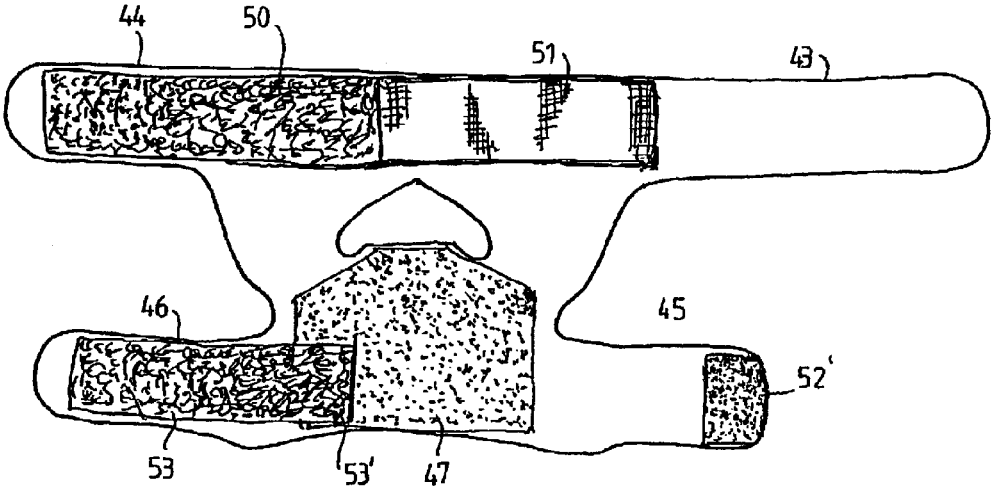
Figure 11:
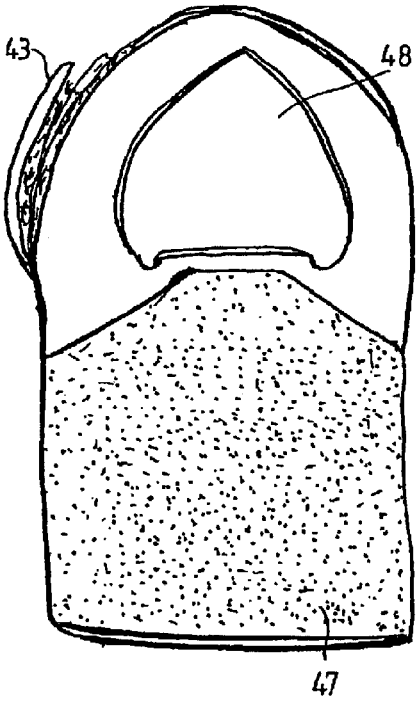
FIGS. 11 and 12 are an underside view and top view of the article of footwear of FIGS. 9 and 10 in a connected attitude as applied to the foot of a user.
Figure 12:
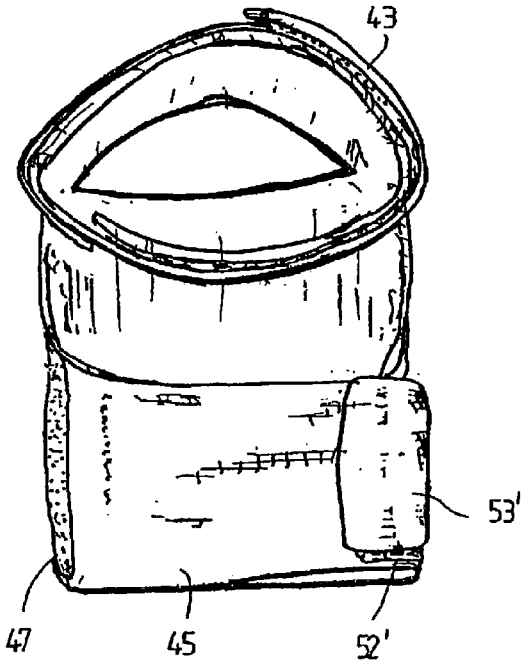

The article of footwear 40 may be in a number of different designs as may the pad or pads 62 with which the footwear article 40 is engaged. Thus the article of footwear 40 may be used in combination with the pad assembly 10 or pad 30 with maximum grip being achieved when the pad 47 is located over the rib 22 such as to effect engagement between the complementary portions of the hook and loop fastener and additional grip being achieved through physical engagement with the rib 22. The heel and toes of the user are free to engage either the pad 12 or adjacent surface of the surfboard to provided improved grip and feel. It will also be appreciated that the design of the article of footwear 40 as shown in FIGS. 9 and 10 is such that it can be used either on the left or the right foot. Further the article of footwear 40 of one size can fit a large range of sizes of foot by simply tightening the straps 43 and 44 and 45 and 46 around the foot.

The configuration of the pad assemblies 10 and 30 are such that many different combinations of grip may be achieved (by use of the overtreads 27 where required) or by use of different combinations of pads 10 and 30.

Whilst the above has been given by way of illustrative embodiment of the invention, all variations and modifications thereto as would be apparent to persons skilled in the art are deemed to fall within the broad scope and ambit of the invention as defined in the appended claims.

What is claimed is:

1. A ground or floor pad assembly for use in combination with a garment worn by a person, said pad assembly comprising a pad member, said pad member having at least one aperture or recess therein and at least one insert having an external configuration complementary to the shape of said aperture or recess and being received within said aperture or recess of said pad member, said pad assembly having a plurality of grip enhancing zones having different grip properties, at least one of said zones comprising a hook and loop fastener on said at least one insert and said garment having one or more zones of a complementary hook and loop fastener such that in use, by varying the position of placement of said garment on said pad assembly and thus varying the contact between said zones of said garment and said pad assembly, said person wearing the garment can selectively control the extent of engagement between said garment and said pad assembly to vary the grip between said garment and said pad assembly.

2. A surfboard deck pad assembly for attachment to the deck of a surfboard, said pad assembly including a pad member, an aperture or recess with said pad member and an insert having an external configuration complementary to the shape of said aperture or recess and being received therein, said insert having on its upper surface, a hook and loop fastener and said pad member having a zone or zones comprising a non-slip surface.

3. A surfboard deck pad assembly according to claim 2 in combination with an article of footwear to be worn by a person, said article of footwear having a zone or zones of a hook and loop fastener complementary to said hook and loop fastener on said insert and a leg rope fixed at one end to said article of footwear and being attachable at its opposite end to a surfboard.

4. A deck pad assembly, said pad assembly comprising a pad member and an insert within said pad member, said pad assembly being adapted to be attached to the deck of a watercraft, skateboard or other article to which enhanced grip is required, said insert having on its upper surface, a hook and loop fastener adapted for cooperation with a garment having one or more zones of a complementary hook and loop fastener and a an overtread for covering said insert, said overtread having on its upper side, a non-slip surface, said overtread having on its lower side a hook and loop fastener complementary to said hook and loop fastener on said insert.

5. A deck pad assembly, said pad assembly comprising a pad member, said pad member having an aperture or apertures therein and at least one insert, said insert or inserts having an external configuration complementary to the shape of said aperture or respective said apertures and being received therein, said pad assembly being adapted to be attached to the deck of a watercraft, skateboard or other article to which enhanced grip is required, said insert or inserts having on its or their upper surface or surfaces, a hook and loop fastener adapted for cooperation with a garment having one or more zones of a complementary loop fastener.

6. A pad assembly according to claim 5 wherein said zones of hook and loop fastener on said insert or inserts substantially cover the upper exposed surface/s of said insert or inserts.

7. A pad assembly according to claim 5 wherein said pad member has a single central aperture to receive an insert such that the pad member peripherally surrounds the insert.

8. A pad assembly according to claim 7 wherein said insert has one or more raised ribs or ridges on its upper side.

9. A pad assembly according to claim 8 wherein said rib or ridges extend longitudinally relative to the pad assembly.

10. A pad assembly according to claim 5 wherein said pad member includes at least one zone of a non-slip material defining a non-slip surface.

11. A pad assembly according to claim 5 wherein the lower surfaces of the pad member and at least one insert are provided with a layer of a pressure sensitive or contact adhesive.

12. A pad assembly according to claim 5 wherein the hook and loop fastener on the at least one insert is disposed, at least around the outer periphery of the insert, below the surface of the adjacent portions of the pad member.

13. A pad assembly according to claim 12 wherein the hook and loop material is folded downwardly around the periphery of the at least one insert.

14. A pad assembly according to claim 5 in combination with a garment to be worn by a person, said garment having a zone or zones of a hook and loop fastener complementary to said hook and loop fastener of said pad assembly such that in use, by varying the position of placement of said garment on said pad assembly and thus varying the contact between said hook and loop fasteners of said garment and said pad assembly, said person wearing the garment can selectively control the extent of engagement between said garment and said pad assembly to vary the grip between said garment and said pad assembly.

15. The combination of claim 14 wherein said garment comprises an article of footwear having a first retaining portion adapted to extend over and be secured about the foot of a user and a second retaining portion adapted to extend around and be secured to the ankle of a user, and a grip zone comprising said hook and loop fastener adapted to be located in use under the foot of the wearer so as to leave die toes and the heel free.

16. The combination of claim 15 wherein said article of footwear includes a main body formed of a planar material, and wherein said first retaining portion includes opposite straps which may be looped about the foot of the user and interconnected.

17. The combination according to claim 16 wherein said straps include complementary hook and loop fasteners which permit the straps to be interconnected.

18. The combination according to claim 16 wherein said second retaining portion includes further opposite straps which may be interconnected about the ankle of the user, said straps including zones of complementary hook and loop fastener for interconnecting said further straps around the ankle of the user.

19. The combination according to claim 16 wherein said main body includes a central opening for receipt of the heel of the user.

20. The combination of claim 15 wherein said pad assembly comprises a surfboard deck pad assembly and wherein said article of footwear includes a leg rope for attachment to a surfboard said leg rope being fixed at one end to or adjacent said second retaining portion.

* * * * *